US006497591B2

(12) United States Patent
Fujita

(10) Patent No.: US 6,497,591 B2
(45) Date of Patent: Dec. 24, 2002

(54) CONNECTOR

(75) Inventor: Shinya Fujita, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/027,098

(22) Filed: Dec. 26, 2001

(65) Prior Publication Data

US 2002/0086588 A1 Jul. 4, 2002

(30) Foreign Application Priority Data

Dec. 28, 2000 (JP) ..... 2000-400088

(51) Int. Cl.[7] ..... H01R 13/436
(52) U.S. Cl. ..... 439/752
(58) Field of Search ..... 439/752, 595

(56) References Cited

U.S. PATENT DOCUMENTS 5,378,176 A 1/1995 Sasai ..... 439/752
5,651,703 A * 7/1997 Sasai ..... 439/752
5,865,653 A * 2/1999 Okada et al. ..... 439/752
5,897,402 A * 4/1999 Sasai et al. ..... 439/752
5,980,333 A * 11/1999 Nakamura et al. ..... 439/752

* cited by examiner

*Primary Examiner*—Gary Paumen
(74) *Attorney, Agent, or Firm*—Anthony J. Casella; Gerald E. Hespos

(57) ABSTRACT

A retainer (40) has side plates (45) that slide against sliding-contact surfaces (29) of a female housing (20). Each sliding-contact surface (29) has an obliquely extending guide rib (33) and a locking projection (36) above the guide rib (33). The inner surface of each side plate (45) has a guide groove (46) into which the guide rib (33) is fittable and a locking hole (50) into which the locking projection (36) is fittable. Terminal fittings (11) are inserted into cavities (25) of the housing (20) and then the retainer (40) is pushed along the guide ribs (33) to a full locking position where the front edges of the side plates (45) contact the front edges of the sliding-contact surfaces (29) and the locking projections (36) are located in the locking holes (50) to doubly lock the terminal fittings (11) in the cavities (25).

15 Claims, 10 Drawing Sheets

CONNECTOR

BACKGROUND OF THE INVENTION

1. Field of the Invention

The invention relates to a connector with a retainer for locking terminal fittings in a connector housing.

2. Description of the Related Art

A known connector with a retainer that is insertable in an oblique direction is disclosed in U.S. Pat. No. 5,378,176 and also is shown in FIGS. 15–17 herein. This connector shown in FIGS. 15–17 comprises a connector housing 1 formed with cavities 2 into which terminal fittings 3 are inserted from behind. A retainer 4 has locking portions 5 at its leading end and is mountable to cover an open part of the lower surface of the connector housing 1. The retainer 4 is held initially at a partial locking position where the locking portions 5 are retracted from the cavities 2. Thus, the terminal fittings 3 can be inserted into and withdrawn from the cavities 2. The retainer 4 is pushed obliquely toward a full locking position after the terminal fittings 3 are inserted into the cavities 2. At the full locking position, the locking portions 5 enter the cavities 2 and engage the terminal fittings 3 from behind with respect to insertion direction, thereby locking the terminal fittings 3.

The obliquely inserted retainer has an advantage that insufficiently inserted terminal fittings 3 can be pushed to their proper insertion positions as the retainer 4 is pushed to the full locking position, as shown in FIG. 15.

On the other hand, side plates 6 provided at the opposite ends of the retainer 4 are held in sliding contact with the opposite side surfaces of the connector housing 1. Three projections 7A, 7B, 7C are provided on each side surface of the connector housing 1 and are spaced apart along a moving direction of the retainer 4. A groove 8 is formed in each side plate 6 for receiving two adjacent projections 7A to 7C. The retainer 4 is held at the partial locking position with the two projections 7A, 7B at the rear side fitted in the grooves 8, as shown in FIG. 16, and is held at the full locking position with the two projections 7B, 7C at the front side fitted in the grooves 8, as shown in FIG. 17. The movement of the retainer 4 is guided mainly by the engagement of the middle projections 7B with the grooves 8. However, relatively long grooves 8 need to be formed and the side plates 4 of the retainer 4 accordingly bulge out forwardly.

The connector of FIGS. 15–17 is fitted into a receptacle of a mating male connector as shown in FIG. 17 after the retainer 4 is held at the full locking position. Since the side plates 6 bulge out to positions where they interfere with the leading end of the receptacle 9, dimensions of the receptacle 9 need to be enlarged to avoid interference. This leads to a size enlargement of the connector particularly in widthwise direction.

The present invention was developed in view of the above situation and an object thereof is to make an entire connector assembled by connecting mating connectors smaller.

SUMMARY OF THE INVENTION

The invention is directed to a connector with a connector housing formed with one or more cavities into which the terminal fittings are inserted. A retainer is mountable on outer surfaces of the connector housing and is movable obliquely to an insertion direction of the terminal fittings to lock the terminal fittings in the cavities. The retainer comprises at least one side plate that is engageable with a corresponding side surface of the connector housing. Preferably, the side plate is slideably engaged with the side surface of the connector housing. A guiding portion for guiding movement of the retainer in an oblique direction and a locking portion for locking the retainer are provided between the side plate and the side surface of the connector housing. The guiding portion and the locking portion are spaced from one another in a direction that intersects the moving direction of the retainer. The locking portion preferably is closer than the guiding portion to the leading end of the side plate relative to the moving direction of the retainer.

The retainer preferably can be held at a partial locking position where the retainer is retracted from the cavities to permit insertion and withdrawal of the terminal fittings into and from the cavities. The retainer also can be held at a full locking position where the retainer enters the cavities to engage the terminal fittings from behind with respect to the insertion direction. Preferably, the locking portion locks the retainer at the partial locking position and at the full locking position.

The retainer may be held in the partial locking position by holding the side plate between the locking portion and a stopper wall of the connector housing.

The locking portions preferably are dimensioned to require deflection of the side plates away from one another as the side plates move over the locking portions during the movement of the retainer from the partial locking position to the full locking position. The disposition of the locking portions closer to the projecting ends of the locking plates reduces the amount of deflection of the side plates that is required to move the retainer to the full locking position.

The guiding portion that guides the movement of the retainer in the oblique direction and the locking portion that locks the retainer at the locking positions are displaced in the direction intersecting with the moving direction of the retainer. Therefore, the depth dimension of the side plate can be small. As a result, the side plate bulges out forwardly to only a small degree and is located before the leading end of the receptacle, even when the retainer reaches the full locking position. For example, the connector housing may be fit into the receptacle of a mating connector housing. In this situation, it is not necessary to fit the side plate of the retainer inside the receptacle, and a dimension of the receptacle in widthwise direction can be made smaller, thereby making the entire connector compact.

The guiding portion preferably comprises a guide rib on either one of the side surface of the connector housing and the side plate of the retainer and a guide groove formed in the other thereof. The locking portion preferably comprises a locking projection on either one of the side surface of the connector housing and the side plate of the retainer and a locking hole is formed in the other thereof for engagement with the locking projection.

The movement of the retainer is guided by the movement of the guide groove along the guide rib, and the retainer is held at the locking position by the engagement of the locking projection with the locking hole.

The guide rib may comprise a tapered surface and the guide groove may comprise a corresponding tapered surface.

The locking projection preferably comprises a tapered surface for guiding the retainer during its movement in the moving direction.

Most preferably, the side surface comprises a slanted surface to allow the mounting of the retainer on the connector housing by forcing the side surface to deflect.

The projecting distance of the locking projections from the side surfaces preferably is set smaller than the projecting distance of the guide ribs from the side surfaces.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENT

Figure 1:
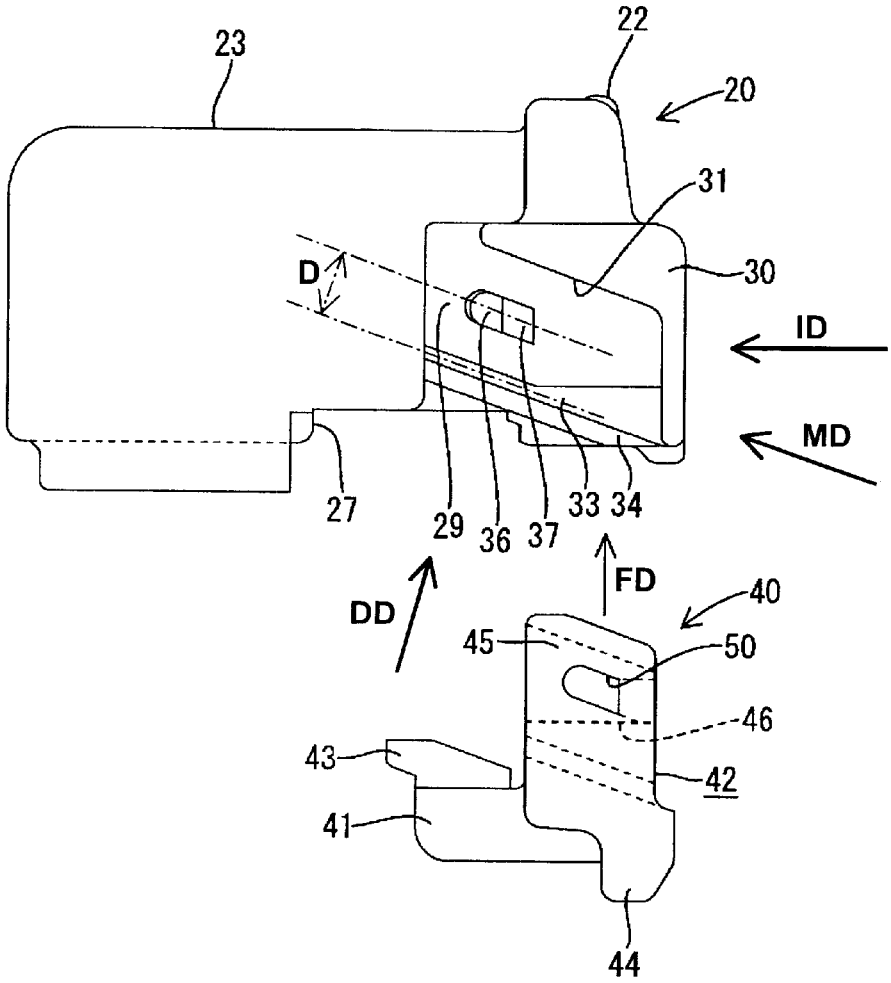
FIG. 1 is an exploded side view of one embodiment of the invention.
Figure 2:
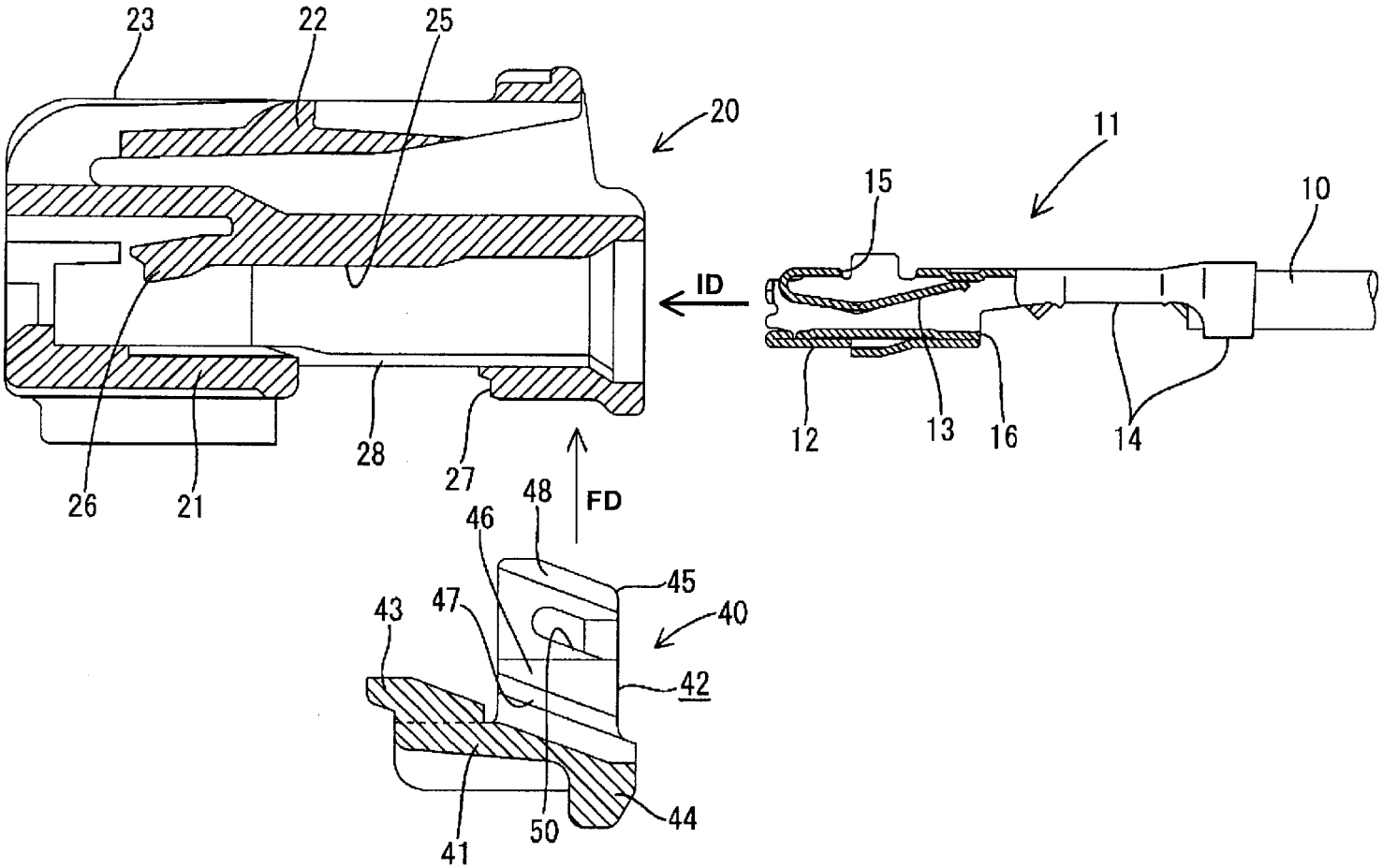
FIG. 2 is an exploded section of the embodiment.

Female terminal fittings 11 are fastened to ends of wires 10 and are accommodated in a female connector housing 20, as shown in FIGS. 1 and 2.

Each female terminal fitting 11 has opposite front and rear ends. A substantially rectangular tube 12 is formed at the front end, and a connecting piece 13 is formed in the rectangular tube 12 for connection with a mating male terminal fitting (not shown). A barrel 14 is provided at the rear end of the female terminal fitting 11 and is fastened to the end of the wire 10 by crimping, bending or folding the barrel 14. A locking hole 15 is formed in the upper wall of the rectangular tube 12, and a jaw 16 is formed at a rear edge of the bottom surface of the rectangular tube 12.

Figure 3:
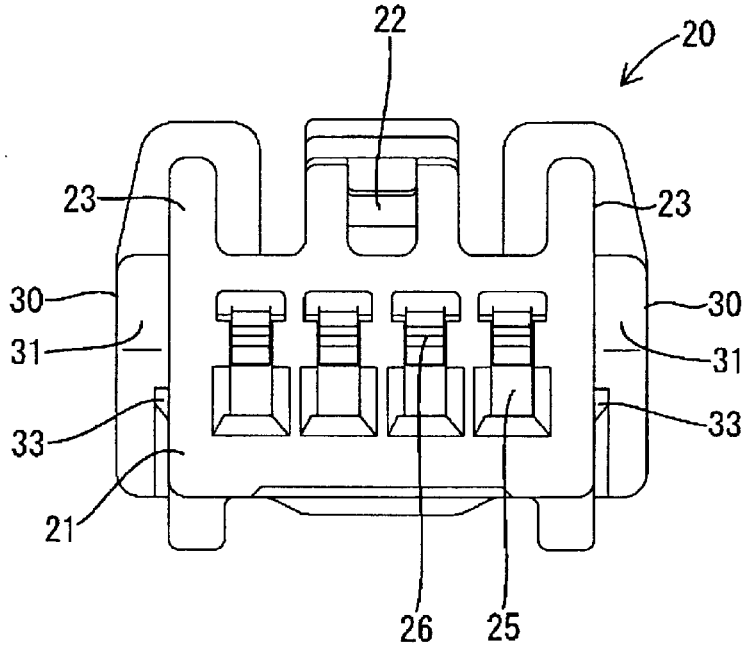
FIG. 3 is a front view of a female housing.
Figure 4:
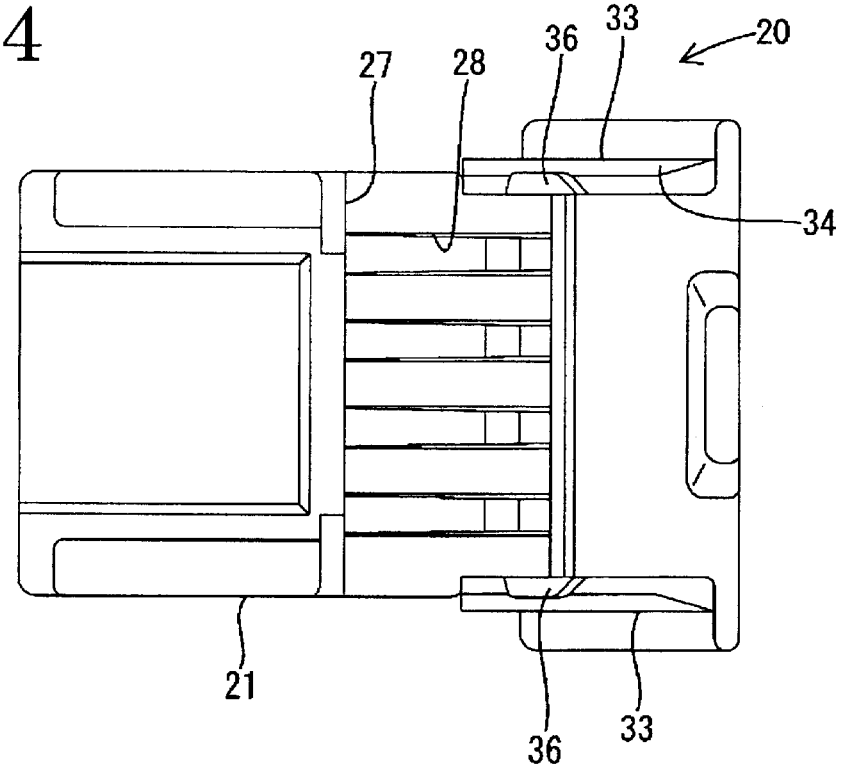
FIG. 4 is a bottom view of the female housing.

The female housing 10 is formed integrally or unitarily e.g. of a synthetic resin and has a main body 21 in the form of a flat block, as shown in FIGS. 3 and 4. The main body 21 can be fit into a receptacle 61 (see chain line in FIG. 10) of a mating male connector housing 60. A lock arm 22 is provided on the upper surface of the main body 21 for locking the female and male housings 20, 60 into each other and a pair of protection walls 23 extend at substantially opposite sides of the lock arm 22.

Cavities 25 are formed substantially side-by-side in the main body 21 and extend in forward and backward or longitudinal directions. The female terminal fittings 11 are inserted into the cavities 25 from behind to their proper positions. Locks 26 are provided on the ceiling or lateral surfaces of the cavities 25 and fit resiliently into the locking holes 15 of the terminal fittings 11. As a result, the female terminal fittings 11 are partly locked.

A retainer mounting recess 27 is formed slightly behind the longitudinal center of the bottom surface of the main body 21 of the female housing 20 and extends over substantially the entire width of the main body 21. Four longitudinally extending insertion grooves 28 are formed in the ceiling surface of the retainer mounting recess 27 and communicate with the bottom surfaces of the respective cavities 25. Further, left and right side surfaces at the rear end of the main body 21 are recessed slightly to form sliding-contact surfaces 29. A stopper wall 30 bulges out from the upper edge over to the rear edge of each sliding-contact surface 29, and the bottom surface of the upper part of the stopper wall 30 defines a guide surface 31 that is sloped down to the back in a direction that intersects the longitudinal direction of the female connector housing 20.

Figure 5:
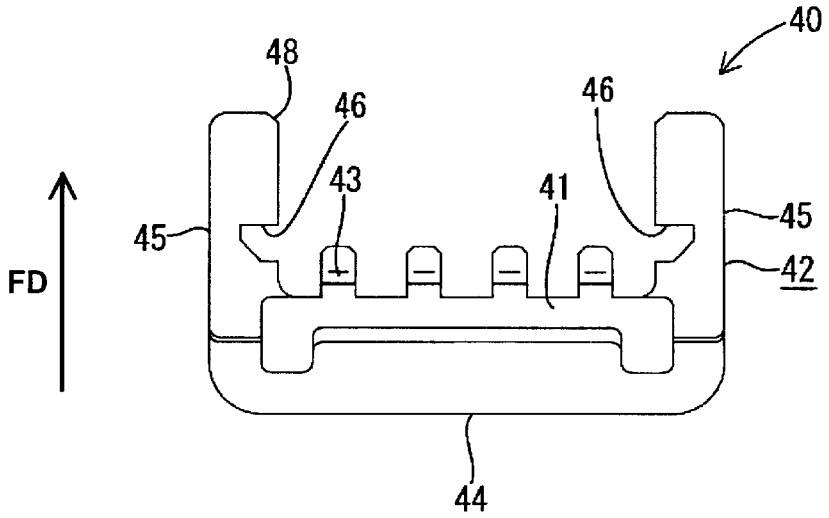
FIG. 5 is a front view of a retainer.
Figure 6:
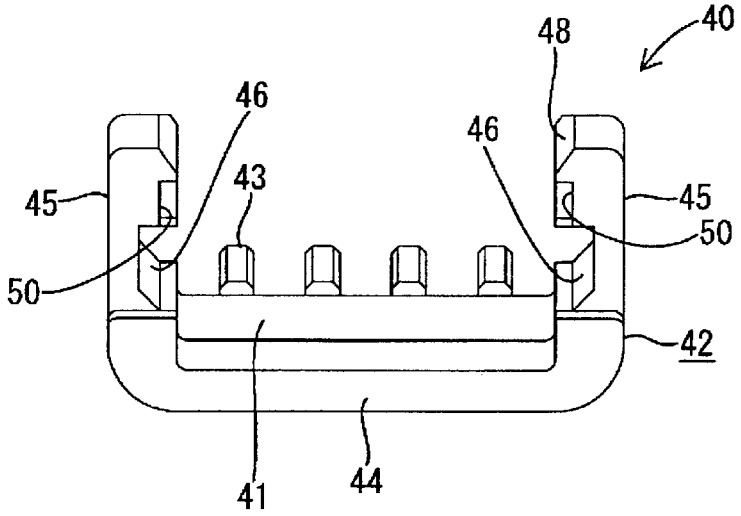
FIG. 6 is a rear view of the retainer.

A retainer 40 formed e.g. of a synthetic resin includes a base plate 41. An operable portion 42 is formed continuously at the rear end of a base plate 41 for substantially covering almost the entire retainer mounting recess 27, as shown in FIGS. 5 and 6. Four locks 43 project forward at intervals along the widthwise direction at the leading end of the upper surface of the base plate 41. The locks 43 enter the respective cavities 25 through the corresponding insertion grooves 28 to engage the jaws 16 of the female terminal fittings 11 inserted into the cavities 25.

The operable portion 42 of the retainer 40 has a U-shape when viewed from the front (FIGS. 5 and 6), and includes a grip 44 and side plates 45. The grip 44 bridges the bottom surface of the main body 21 of the female housing 20 and the side plates 45 extend from opposite ends of the grip 44. Each side plate 45 has a width that is substantially half the dimension of the sliding-contact surfaces 29 extending along the direction of insertion ID of the female terminal fittings 11 or in the moving direction MD. Upper edges of the side plates 45 are formed obliquely and substantially parallel with the guide surfaces 31 of the stopper walls 30.

A guide rib 33 is formed near a bottom end of each sliding-contact surface 29 with respect to the height direction or the fitting direction FD and is substantially parallel to the guide surface 31. The upper edge of the rear end of the guide rib 33 extends substantially horizontally to widen the guide rib 33 gradually and a tapered surface 34 is formed at the entire bottom edge. On the other hand, a guide groove 46 is formed in the inner surface of each side plate 45 of the retainer 40 and the guide rib 33 is fittable in the guide groove 46. Specifically, as shown in FIG. 2, the guide groove 46 is configured to closely receive the widened portion at the rear end of the guide rib 33 and a portion thereof slightly before it, and a tapered surface 47 is formed at the bottom edge of the guide groove 46 substantially in alignment with the tapered surface 34 of the guide rib 33. A slanted surface 48 is formed at a corner at the upper end of the rear surface of each side plate 45.

Figure 7:
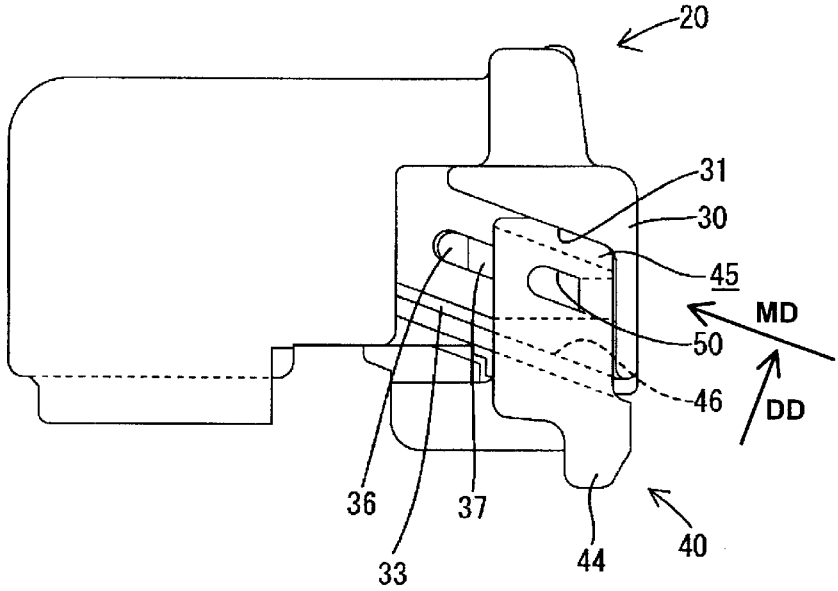
FIG. 7 is a side view showing a state where the retainer is held at a partial locking position.
Figure 8:
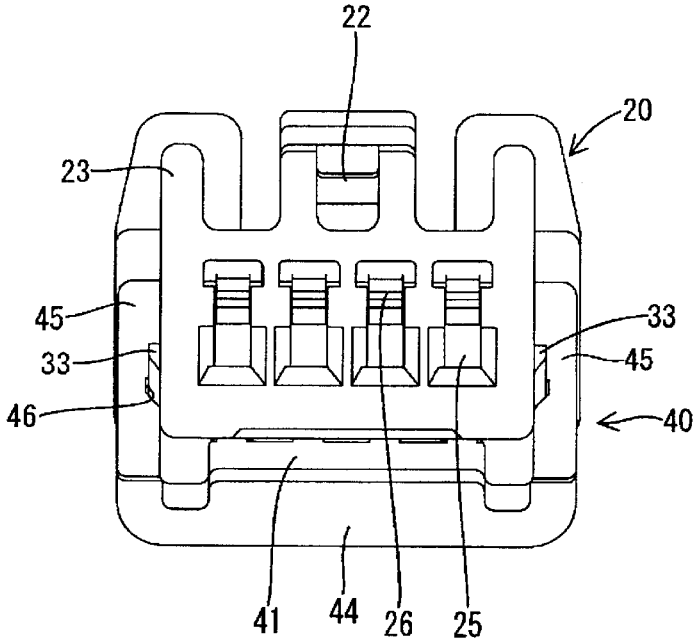
FIG. 8 is a front view showing the state of FIG. 7.

A locking projection 36 is formed on each sliding-contact surface 29 of the female housing 20 at a position above the guide rib 33 and immediately before the front edge of the side plate 45 when the retainer 40 is mounted at a partial locking position (see FIG. 7). The locking projections 36 are provided on the connector housing 20 in a position that corresponds more to a leading end of the side plates 45. Additionally, the locking projections 36 are spaced a distance D from the guide ribs 33 along the displacement direction DD so that the guide ribs 33 are closer than the locking projections 36 to the base plate 41 of the retainer 40. Thus the front or distal portion of the side plates 45 first contacts the guide ribs 33 and then the locking projections 36 during fitting of the retainer 40 onto the connector housing 20 in the fitting direction FD. As a result, the side plates 45 are deformed resiliently to a smaller degree as compared to a case where the locking projections are nearer the base ends of the side plates. Thus resistance force during movement of the retainer is reduced.

Figure 13:
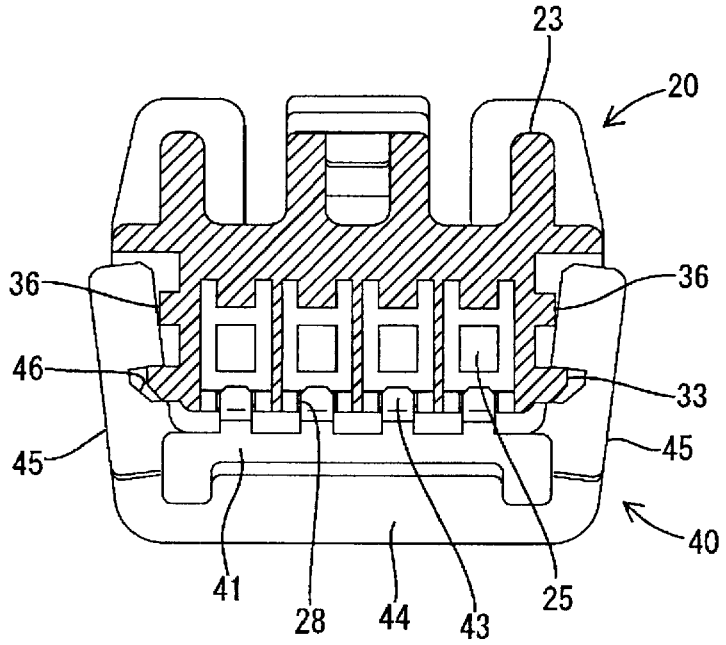
FIG. 13 is a section showing a process of moving the retainer to the full locking position.

The locking projection 36 is slightly narrow in forward and backward directions and is sufficiently oblique to be substantially parallel with the guide rib 33. An upward sloped tapered surface 37 is formed at the rear half of the locking projection 36. Further, as shown in FIG. 13, projecting distances of the locking projections 36 from the sliding contact surface 29 are smaller than the projecting distances of the guide ribs 33 from the sliding contact surfaces 29.

A locking hole 50 is formed in the rear surface of each guide plate 45 at a position above the guide groove 46, and is dimensioned to receive the locking projection 36. Specifically, the locking projection 36 is engageable with the locking hole 50 when the retainer 40 reaches its full locking position (see FIG. 10) where the front edges of the side plates 45 are in contact with the front edges of the sliding-contact surfaces 29.

The connector is assembled by initially mounting the retainer 40 at its partial locking position. During this operation, the side plates 45 are placed at the rear side of the sliding contact surfaces 29, as shown in FIGS. 1 and 2, and the retainer 40 is fitted in a fitting direction FD to substantially cover the bottom surface of the female housing 20. The spacing between the side plates 45 is widened as the slanted surfaces 48 at the upper ends of the rear surfaces of the side plates 45 move over the tapered surfaces 34 of the guide ribs 33. The retainer 40 is pushed until the upper edges of the side plates 45 contact the guide surfaces 31 of the stopper walls 30. The side plates 45 then move toward each other to fit the guide ribs 33 into the guide grooves 46.

Figure 9:
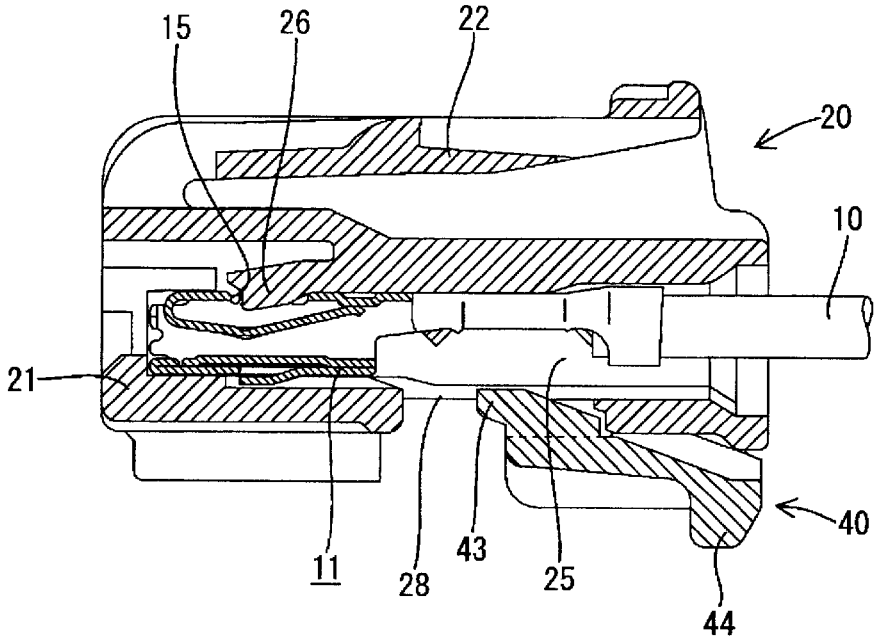
FIG. 9 is a longitudinal section showing the state of FIG. 7.

At this stage, the front and rear edges of the side plates 45 are held between the locks 36 and the rear of each stopper walls 30 as shown in FIG. 7. Thus, the retainer 40 is held at the partial locking position and movements of the retainer 40 along the moving direction MD are restricted. At this partial locking position, the locks 43 of the retainer 40 are located in the insertion grooves 28, but are still retracted at the bottom surfaces of the cavities 25, as shown in FIG. 9.

The female terminal fittings 11 then are inserted from behind to their proper insertion positions in the cavities 25 while the retainer 40 is at the partial locking position. As a result, the female terminal fittings 11 are locked partially by the locks 26.

Figure 10:
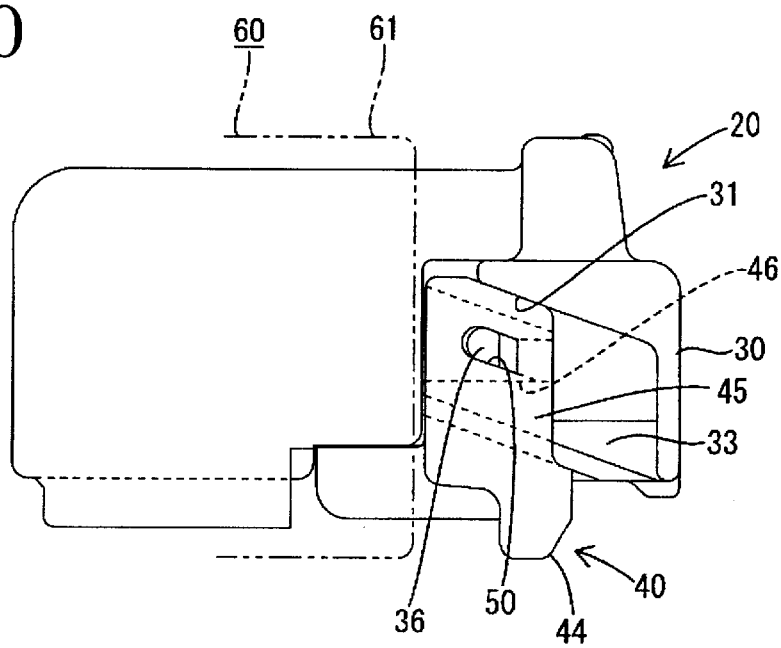
FIG. 10 is a side view showing a state where the retainer is held at a full locking position.
Figure 11:
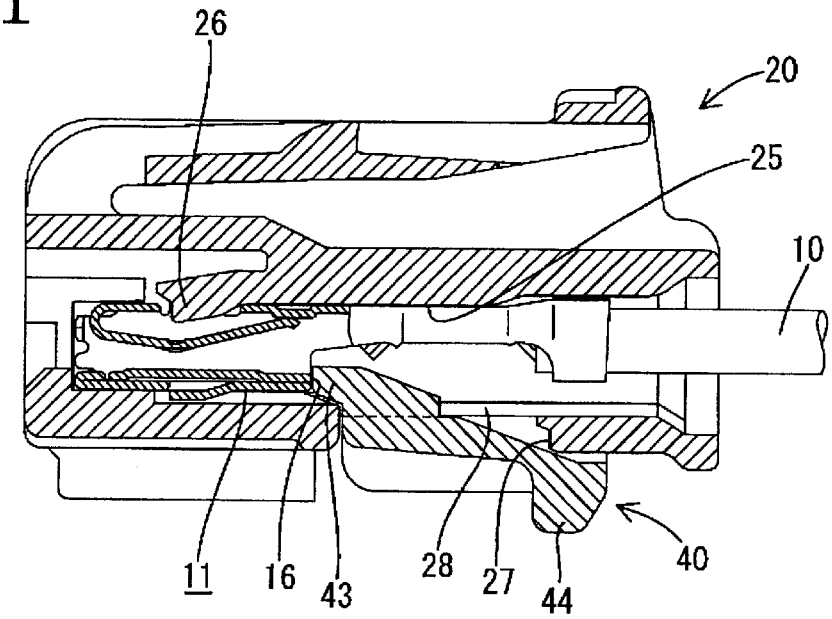
FIG. 11 is a longitudinal section showing the state of FIG. 10.
Figure 12:
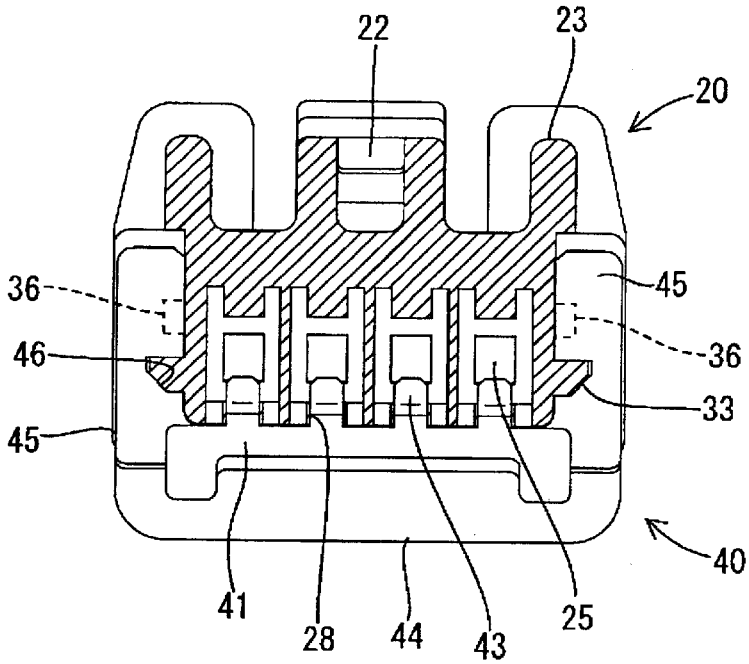
FIG. 12 is a lateral section showing the state of FIG. 10.

The retainer 40 is held by the grip 44 and pushed forward in a moving direction MD after all of the female terminal fittings 11 have been inserted into the cavities 25. More particularly, the retainer 40 is pushed obliquely upward or toward the cavities 25 in the female connector housing 20 so that the upper surfaces of the side plates 45 move along the guide surfaces 31 and the guide grooves 46 move along the guide ribs 33. Additionally, the side plates 45 move onto the tapered surfaces 37 of the locking projections 36. At this stage, the base end portions of the guide ribs 33 come out of the guide grooves 46, but the leading ends of the guide ribs 33 remain in the guide grooves 46. Thus, even if a downwardly acting force acts on the retainer 40, the retainer 40 is unlikely to disengage from the connector housing 20. The retainer 40 is pushed to the full locking position where the front edges of the side plates 45 contact the front edges of the sliding-contact surfaces 29. Thus, the side plates 45 are restored resiliently to their original shapes and move over the locks 36. Hence, the locks 36 engage the locking holes 50 of the side plates 45 to hold the retainer 40 at the full locking position, as shown in FIG. 10. At the full locking position, the locks 43 enter the corresponding cavities 25 and engage the jaws 16 of the female terminal fittings 11 from behind or from a direction to avoid their withdrawal, as shown in FIG. 11. As a result, the female terminal fittings 11 are locked doubly.

Figure 14:
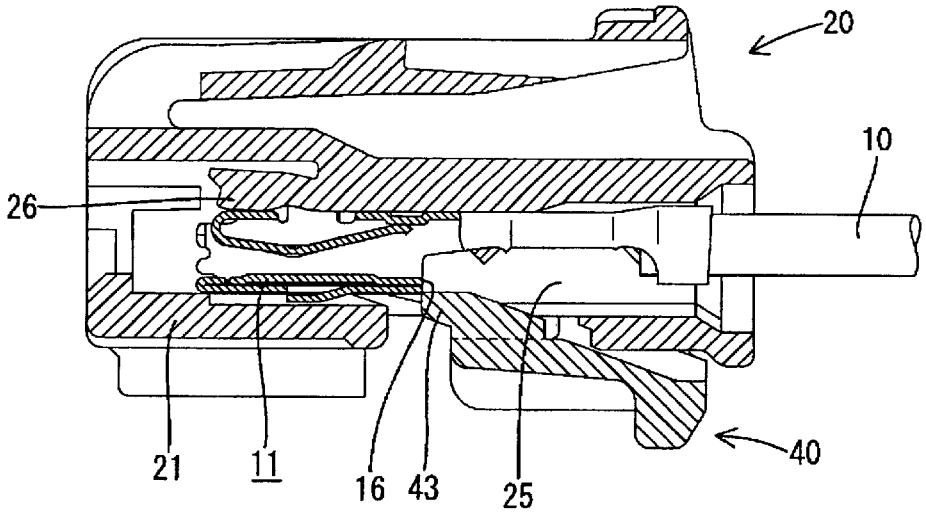
FIG. 14 is a section showing an operation of correcting an insufficiently inserted female terminal fitting.
Figure 15:
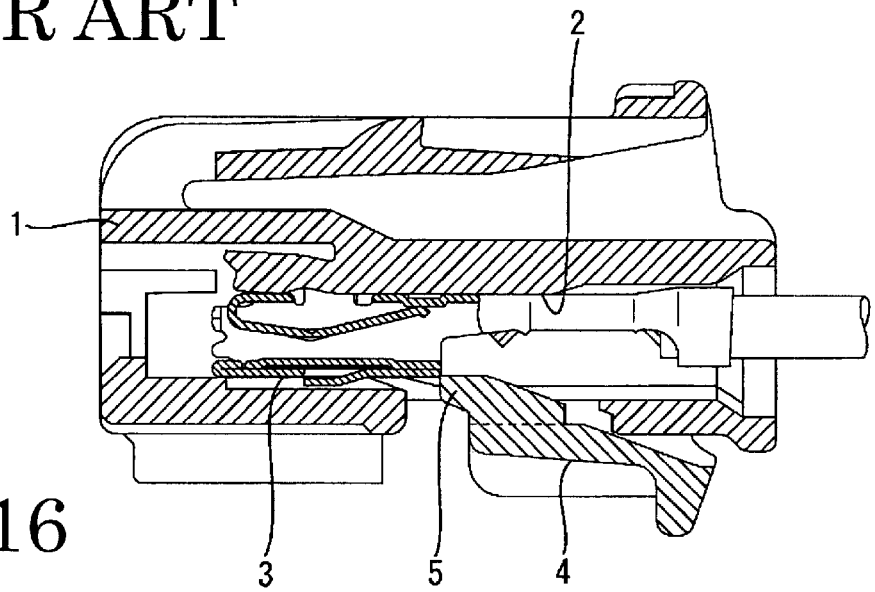
FIG. 15 PRIOR ART
FIG. 15 is a longitudinal section of a prior art connector.
Figure 16:
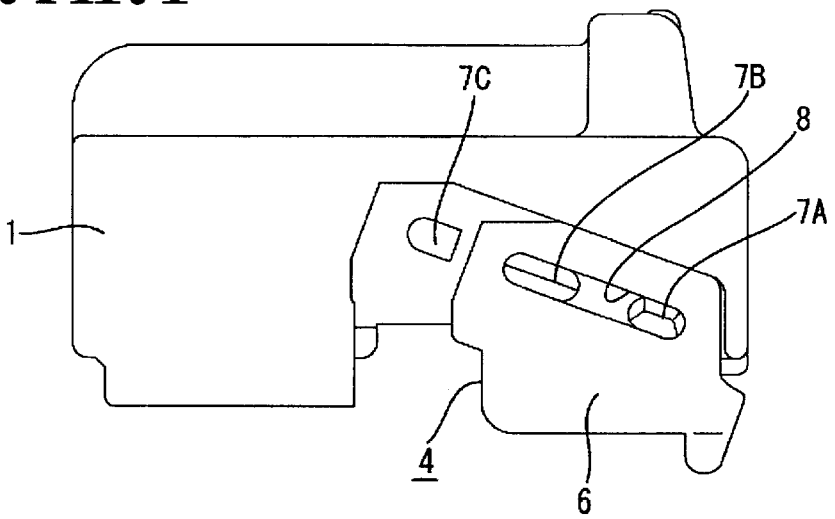
FIG. 16 PRIOR ART
FIG. 16 is a side view showing a state where a retainer of the prior art connector is at a partial locking position.
Figure 17:
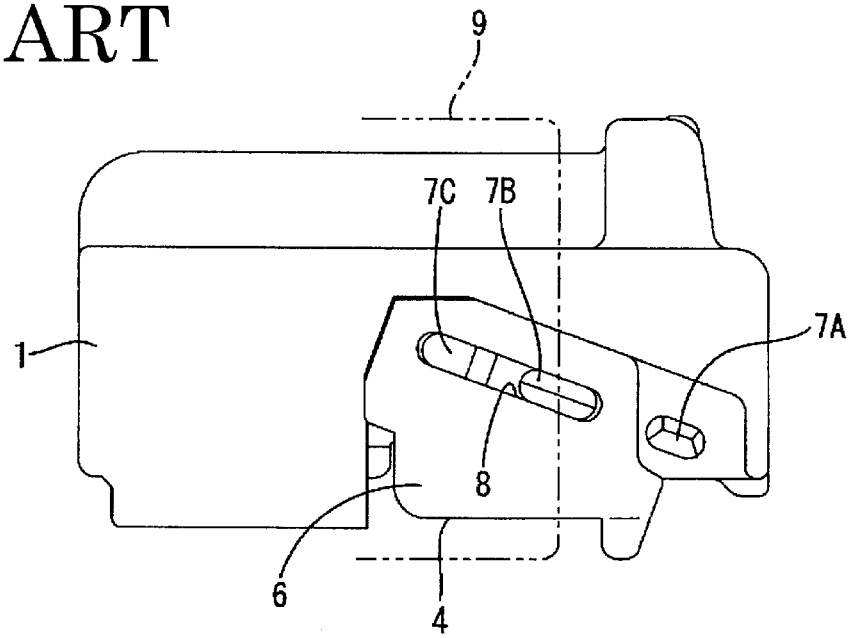
FIG. 17 PRIOR ART
FIG. 17 is a side view showing a state where the retainer of the prior art connector is at a full locking position.

There are cases where the female terminal fitting 11 is not pushed to its proper position due, for example, to a resistance from the lock 26 when inserting the female terminal fitting 11 into the cavity 25. Thus, the female terminal fitting 11 is left insufficiently inserted. In such cases, the lock 43 pushes the jaw 16, as shown in FIG. 14, as the retainer 40 is pushed from the partial locking position to the full locking position, and the female terminal fitting 11 is pushed to its proper position.

After the retainer 40 is at the full locking position as described above, the female housing 20 is fitted into the receptacle 61 of the mating male housing 60 as shown in FIG. 10.

As described above, the guide ribs 33 for guiding the oblique movement of the retainer 40 and the locking projections 36 for locking the retainer 40 at the full locking position are spaced from one another by a distance D (e.g., a few millimeters) in a direction DD that intersects the moving direction MD of the retainer 40. Thus, the side plates 45 of the retainer 40 can be made smaller along the mating direction MD by providing the guide grooves 46 and the locking holes 50 engageable with the guide ribs 33 and the locking projections 36 on the side plates 45. As a result, the side plates 45 bulge out forward to a smaller degree when the retainer 40 reaches its full locking position, and are located at a position before the leading end of the receptacle 61 when the female housing 20 is fitted into the receptacle 61 of the mating male housing 60. In other words, the side plates 45 of the retainer 40 need not be located inside the receptacle 61, and the width of the receptacle 61 can be made smaller.

The present invention is not limited to the above described and illustrated embodiment. For example, following embodiments also are embraced by the technical scope of the present invention as defined in the claims. Beside the following embodiments, various changes can be made without departing from the scope and spirit of the present invention as defined in the claims.

The present invention is also applicable to connectors of the type in which cavities are provided at two stages and upper and lower retainers are inserted obliquely from upper and lower sides.

The present invention is effectively applicable to male connectors depending on the shapes of connector housings.

What is claimed is:

1. A connector comprising: a connector housing (20) formed with cavities (25) extending along an insertion direction (ID) for receiving terminal fittings (11) inserted along the insertion direction (ID), a U-shaped retainer (40)

having a grip (44) and two opposed side plates (45) extending from the grip (44), the side plates (45) being engageable with opposite outer side surfaces (29) of the connector housing (20), guiding means (33; 46) provided on the side plates (45) and the outer side surfaces (29) of the connector housing (20) for guiding a movement of the retainer (40) in a moving direction (MD) aligned oblique to the insertion direction (ID) and lock means (36; 50) between the side plates (45) and the outer side surfaces (29) of the connector housing (20) for locking the retainer (40) on the connector housing (20), the guiding means (33; 46) being disposed between the lock means (36; 50) and the grip (44) and being spaced from the lock means (36; 50) a selected distance (D) in a direction (DD) intersecting with the moving direction (MD) of the retainer (40).

2. The connector of claim 1, wherein the retainer (40) is engageable releasably at a partial locking position (FIG. 7) where the retainer (40) is retracted sufficiently from the cavities (25) to permit insertion and withdrawal of the terminal fittings (11) into and from the cavities (25) and the retainer (40) being engageable at a full locking position (FIG. 10) where the retainer (40) enters the cavities (25) to engage the terminal fittings (11) from behind with respect to the insertion direction (ID).

3. The connector of claim 2, wherein the lock means (36; 50) comprises a lock (36) formed on each of the outer side surfaces (29) and a locking hole (50) formed on each of the side plates (45).

4. The connector of claim 3, wherein the locks (36) are configured to require deflection of the side plates (45) away from one another for moving the retainer (40) from the partial locking position (FIG. 7) to the full locking position (FIG. 10).

5. The connector of claim 3, wherein the side plates (45) are configured for sliding contact with the outer side surfaces (29) of the connector housing (20).

6. The connector of claim 5, wherein the outer side surfaces (29) of the connector housing (20) are substantially normal to a retainer mounting surface (27) of the retainer (40).

7. The connector of claim 3, wherein the guide means (33; 46) comprise guide ribs (33) provided on the outer side surfaces (29) of the connector housing (20) and guide grooves (46) on the side plates (45) of the retainer (40).

8. The connector of claim 7, wherein the guide ribs (33) project further than the locks (36) from the outer side surfaces (29) of the connector housing (20).

9. The connector of claim 7, wherein the guide ribs (33) are formed with tapered surfaces (34) and wherein the guide grooves (46) are formed with corresponding tapered surfaces (47).

10. The connector of claim 9, wherein the locking projection (36) comprises a tapered surface (37) for guiding the retainer (40) during its movement in the moving direction (MD).

11. The connector of claim 1, wherein the side surface (45) comprises a slanted surface (48) for mounting of the retainer (40) on the connector housing (20) by forcing the side surface (45) to deflect.

12. A connector, comprising: a housing (20) formed with cavities (25) extending through the housing (20) in an insertion direction (ID), terminal fittings (11) being inserted respectively in the cavities (25), the housing (20) further having first and second outer side surfaces (29) and an retainer mounting surface extending between the side surfaces (29), a retainer (40) moveably mounted on the housing (20), the retainer (40) comprising first and second side plates (45) and a base plate (44) extending between the side plates (45), the first and second side plates (45) being engaged respectively with the first and second outer side surfaces (29) of the housing (20), guides (33; 46) for guiding a movement of the retainer (40) in a moving direction (MD) oblique to the insertion direction (ID) and locks (36; 50) for locking the retainer (40), the guides (33; 46) and the locks (36; 50) being provided between the side plates (45) and the side surfaces (29), the guides (33; 46) being between the locks (36; 50) and the base plate (44) and being spaced from one another by a selected distance (D) in a direction (DD) intersecting the moving direction (MD).

13. The connector of claim 12, wherein the side surface (29) of the housing (20) is substantially normal to the retainer mounting surface (27) of the housing (20).

14. The connector of claim 13, wherein the guides (33; 46) comprise a guide rib (33) provided on each outer side surface (29) of the housing (20) and guide grooves (46) on the side plates (45) of the retainer (40).

15. The connector of claim 14, wherein the guide ribs (33) comprise tapered surfaces (34) and the guide grooves (46) comprise corresponding tapered surfaces (47).

* * * * *